United States Patent [19]

Green et al.

[11] 4,256,263

[45] Mar. 17, 1981

[54] SPRAY NOZZLE FOR SHOWER APPARATUS

[75] Inventors: Peter T. Green; Nicholas J. Beck, both of Teukesbury, England

[73] Assignee: Walker Crosweller & Company Limited, Gloucestershire, England

[21] Appl. No.: 113,227

[22] Filed: Jan. 18, 1980

Related U.S. Application Data

[63] Continuation of Ser. No. 907,031, May 17, 1978, abandoned.

[51] Int. Cl.[3] ..... B05B 1/34

[52] U.S. Cl. ..... 239/487; 239/497

[58] Field of Search ..... 239/487, 488, 490, 491, 239/494, 496, 486, 497

[56] References Cited

U.S. PATENT DOCUMENTS

| | | | |
|---|---|---|---|
| 1,282,176 | 10/1918 | Binks | 239/488 |
| 2,435,605 | 2/1948 | Rowell | 239/488 |
| 3,072,346 | 1/1963 | Wahlin | 239/487 |
| 3,999,714 | 12/1976 | Lang | 239/570 |

FOREIGN PATENT DOCUMENTS

| | | | |
|---|---|---|---|
| 851714 | 10/1939 | France | 239/497 |
| 318743 | 3/1957 | Switzerland | 239/488 |

*Primary Examiner*—Jeffrey V. Nase
*Assistant Examiner*—Gene A. Church
*Attorney, Agent, or Firm*—Imirie & Smiley

[57] ABSTRACT

A spray nozzle for use in the spray head of shower bathing apparatus and primarily for use with high pressure water systems. The nozzle comprises a ducted body housing a swirl device having fixed guide vanes extending radially from a generally cylindrical hub and substantially flat guide faces angled relative to the hub axis which impart a swirling motion to water flowing through the body and which direct the water onto a converging wall and thence to a single nozzle orifice of right cylindrical configuration, whereby the water issues as a cone-shaped spray which is "full" of water droplets. The nozzle is suitable for use over a wide range of pressures above 1 bar (1 atmosphere) as the level of comfort of the user is maintained at the higher pressures.

8 Claims, 8 Drawing Figures

SPRAY NOZZLE FOR SHOWER APPARATUS

Figure 2:
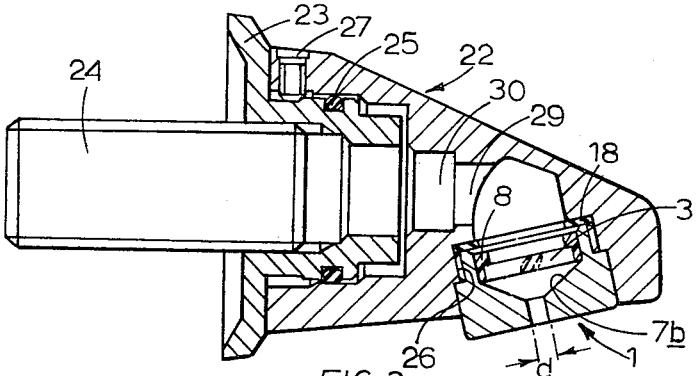

This is a continuation of Application Ser. No. 907,031, filed May 17, 1978, now abandoned.

This invention relates to spray nozzles suitable for use in the spray head of shower-bathing apparatus or other ablutionary appliances. The invention is especially concerned with spray nozzles utilizing a single orifice.

In shower-bathing apparatus it is desirable to provide a full stream of water droplets which is directed from the spray head, which may be fixed or movable. The conventional spray nozzle comprises an outlet having a perforated wall through which the water is forced and which, by careful design of the nozzle and arrangement of perforations, enables a suitable full stream of water droplets to be obtained. However, such spray nozzles suffer from the disadvantage that they tend to lose their efficiency over a period of use as the small perforations become clogged with soap, dirt and lime scale deposition.

To overcome such disadvantage, there has been used spray nozzles having a single orifice with the nozzle being designed to provide a stream of water droplets diverging from the nozzle. However, we have found that in such known single orifice nozzles the stream of water droplets is unsatisfactory for a shower bath either, because the droplets are concentrated on the outside of the stream and the interior may be substantially devoid of water droplets or, because of the excessive force of spray impingement. This will be understood if one considers the spray stream being of conical shape diverging from the orifice, and we have found the cone to be hollow which is unsatisfactory. The spray stream should have a substantially uniform concentration of water droplets so that adequate and proper wetting can occur.

It is an object of this invention to overcome these disadvantages of the single orifice nozzle by providing an improved spray nozzle having a comparatively large waterway which obviates any tendency to become clogged and in use is capable of producing a "full" cone of water.

According to one embodiment of this invention we provide a spray nozzle suitable for use in the spray head of showing bathing apparatus, the nozzle having a single orifice and comprising a body, duct means within the body leading from an inlet therein to the nozzle orifice for the passage of water through the body, the duct means including a chamber intermediate the inlet and the orifice, and swirl means within the chamber for imparting a swirling motion to the water, the chamber having a guide wall shaped to converge the swirling water towards and through the orifice.

According to another embodiment of this invention we provide a spray nozzle for shower-bathing apparatus comprising: a body having a duct extending from an inlet to the outlet for the passage of water therethrough, said outlet being in the form of a single orifice defined by walls of right cylindrical configuration, said duct comprising a chamber positioned between said inlet and said outlet, said chamber housing swirl means comprising a guide member having a plurality of fixed guide vanes for imparting a swirling motion to the water, said guide vanes extending radially from a generally cylindrical hub and having substantially flat guide faces angled relative to the hub axis, and said chamber having a converging guide wall on the downstream side of the swirl means leading directly to said orifice.

Preferably, that part of the chamber adjacent the orifice is of frusto-conical configuration and constitutes the converging guide wall.

Preferably the guide faces of the fixed vanes are rectangular and are disposed at an angle of substantially 45° to the hub axis so that in use water is rotated and directed onto the guide wall as it flows through the swirl means.

Furthermore, in the nozzle that part of the body adjacent the inlet may be adapted to be connected directly to a fixed spray head or to a spray head on the end of a flexible pipe forming part of shower-bathing apparatus, or it may be adapted to be connected to a secondary body part housing an optional flow control device.

Figure 1:
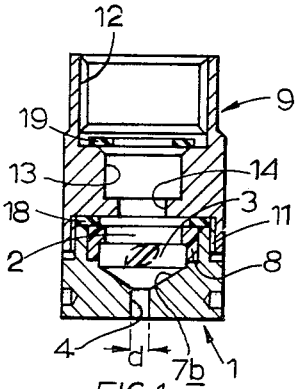
Figure 3:
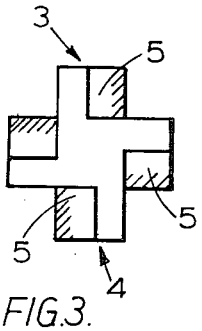
Figure 4:
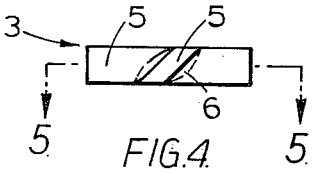
Figure 5:
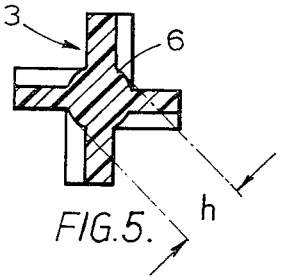
Figure 7:
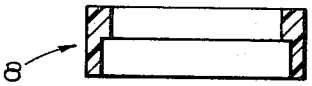
Figure 6:
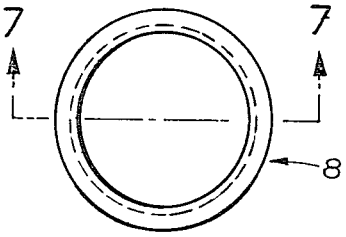
Figure 8:
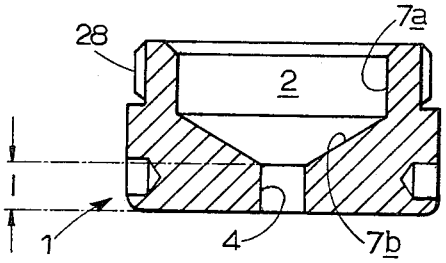

An exemplary embodiment of a spray nozzle according to this invention will now be described with reference to the accompanying drawings wherein:

FIG. 1 is a part cross-section taken on the longitudinal centre line of a spray nozzle in combination with a secondary body part comprising a spray head, the swirl means being shown in elevation, FIG. 2 is a part cross-section taken on the centre line of a modified form of spray head assembly incorporating the nozzle, the swirl means being shown in elevation in a similar manner to FIG. 1, FIG. 3 is an plan view of the swirl means incorporated in the nozzles shown in FIGS. 1 and 2, FIG. 4 is an elevational view of the swirl means of FIG. 3 in the direction of arrow 4, FIG. 5 is a horizontal cross-section on the line 5—5 of FIG. 4, FIG. 6 is a plan view of a retaining ring for the swirl means, FIG. 7 is a cross-section on the line 7—7 of FIG. 6, and FIG. 8 is an enlarged cross-sectional detail of the body of the spray nozzle as shown in FIGS. 1 and 2 excluding the swirl means and retaining ring.

In the exemplary embodiment the spray nozzle comprises a generally cylindrical body 1 formed with a chamber 2. The chamber 2 (see FIG. 8) houses a guide vane member 3 which constitutes the aforementioned swirl means. The chamber 2 comprises an open ended cylindrical inlet part 7*a* and a frusto-conical outlet part 7*b* adjacent the inlet part and terminating in a right cylindrical nozzle orifice 4. The two parts of the chamber 2 and the nozzle orifice 4 together form a duct for the passage of water from a supply source (not shown). This duct constitutes the aforementioned duct means. As compared with the pin-hole perforations of the conventional spray nozzles, or even the orifice of known single orifice spray nozzles the orifice 4 provides a comparatively larger waterway.

The guide vane member 3 is moulded from plastics and comprises four flat faced guide vanes 5 extending radially from and integrally with a generally cylindrical central hub 6. The vanes 5 are angularly spaced on the hub 6 at 90° to each other and each vane is inclined at an angle of about 45° to the axis of the hub. The cylindrical shape of the hub is an important feature of this invention as it was found that any radical departure from this shape, for example towards a square shape, produced a hollow spray pattern having a very low spray force. The angle of the vanes 5 may however be varied between 45° and 60° and still produce a satisfactory spray cone although flow rate and spray cone angle will alter accordingly. Each of the four vanes 5 has a squared outer end. The member 3 is seated in the chamber 2 so that it rests in the mouth of the outlet part *7b* with the vanes 5 extending laterally of the chamber. The member 3 does not rotate in use and is prevented from moving axially within the chamber 2 by a flanged retaining ring 8 which is also of plastics material. The ring 8 bears on the inlet side of the guide member 3 when the nozzle 1 is connected to a secondary body part forming part of a spray head assembly. External threads 28 are provided on the inlet end part of the nozzle for this purpose.

The shape of the guide vane member has been arrived at empirically and as this shape is very important for satisfactory performance of the spray nozzle consistency of shape and dimensions in a mass production process is also very important. In order to ensure such consistency the guide vane member 3 and the retaining ring 8 are preferably manufactured by an injection moulding process.

From the foregoing description of the guide vane member 3 and associated retaining ring 8 it will be appreciated that water entering the inlet part *7a* of the nozzle 1 is confronted by four separate generally triangular shaped apertures defined by the vanes 5 and walls of the ring 8. Each aperture is comparable in area with the area of the nozzle orifice 4 and hence together offer little resistance to the flow of water as it is guided laterally of the chamber 2 and into a swirling motion by the inclined face of each vane 5. It is considered that the improved spray shape produced by a nozzle according to this invention is obtained in part by the ratio of axial angular momentum produced by the guide member 3 to axial linear momentum of water passing through the nozzle, and in part by the particular shape and proportions of the vanes and the swirl chamber 2. Moreover, the nozzle is continually fed from a comparatively large volume of water in the duct upstream of the guide vanes. The optimum dimentions of various parts of the nozzle for the production of a satisfactory spray are as follows.

The diameter (h) of the hub 6 in relation to the diameter (d) of the nozzle orifice 4 is preferably such that the ratio d/h lies between 0.55 and 0.7. It has been found that a ratio of this order reduces the likelihood of producing a hollow spray cone in operation of the nozzle if the ratio is reduced or a jet of water rather than a spray if the ratio is increased. The length (l) of the right cylindrical nozzle orifice 4 should not be excessive as this will tend to cause loss of swirl momentum in water passing from the final outlet and will affect the spray adversely. Preferably, the length (l) should be equal to or only slightly greater than the diameter (d) of the orifice. Similarly, if the nozzle orifice 4 is made convergent the spray is adversely affected. Hence a cylindrical nozzle orifice is essential for good performance.

The angle of the frusto-conical part *7b* governs the gap and hence the water channel between the guide vanes 5 and the orifice 4 and may be varied considerably, for example between 90° and 120° inclusive angle, without any adverse effect on the flow rate or spray cone angle.

In use the nozzle 1 is connected to a secondary body part which serves as a ducted adaptor for mounting the nozzle in a spray head assembly which may be connected to the end of flexible hose or to the end of a rigid supply pipe. FIG. 1 shows a secondary body part 9 adapted to be connected to the end of a flexible supply hose (not shown). The body part 9 is bored to provide cylindrical recesses 11 and 12 in respective outlet and inlet ends thereof. Each recess is screw threaded internally. The recess 11 in the outlet end of the body 9 provides for a screwed connection with the nozzle 1 and the other recesses 12 in the inlet end of the body 9 provides for a screwed connection with the hose. The recess 12 has a first co-axial counterbore providing a cylindrical housing 13 for an optional flow control device (not shown) and a second co-axial counterbore extends to the recess 11 and provides a discharge port 14 for the housing 13. The discharge port 14 is defined by an annular shoulder at the base of the housing and this port also provides a comparatively large area compared with the nozzle orifice 4 for water flowing from the chamber 2.

A sealing ring 18 is interposed between the nozzle 1 and the secondary body part 9 to provide a water-tight joint. Similarly, a sealing ring 19 is located in the recess 12 to seal the connection between the secondary body part 9 and the water feed pipe (not shown) of shower bathing apparatus. In this embodiment the nozzle 1 and the secondary body part 9 comprise the spray head assembly.

A modified form of a spray head assembly embodying the nozzle of this invention is shown in FIG. 2. The nozzle body 1, swirl means 3 and retaining ring 8 of the modified assembly are identical to those shown in FIGS. 1 and 3 to 8 and the same reference numerals have been used to indicate like parts. The secondary body part is formed as a spray head 22 and the nozzle body 1 is adapted to be screwed directly into a recess 26 within the spray head 22 into which recess a feed duct 29 opens. The spray head 22 is in turn located on a hollow spigot of a mounting bush 23 by means of a screw 27 entering an annular recess therein. The bush 23 carries an externally threaded nipple 24 for connection to a fixed water feed pipe (not shown). A seal 25 seals the joint between the spray head 22 and the bush 23. The spray head 22 shown in FIG. 2 may also incorporate the aforementioned flow control device and a cylindrical chamber 3 is provided therein for such purpose.

In operation of the spray nozzle when connected to a spray head as shown in FIGS. 1 and 2, water at a pressure of at least 1 Bar (1 atmosphere) is required to give a satisfactory full spray cone and which is also comfortable for the user. When water at this pressure passes from the supply source through the secondary body 9 or 22 and into the nozzle it will be given a swirling motion as it flows through the channels defined by the angled vanes 5 of the fixed guide vane member 3 and directed so as to flow around the convergent wall of the frusto-conical outlet *7b* before emerging from the orifice 4 as a full cone of water droplets. Another important characteristic of a nozzle made according to this invention is that the spray emitting from the nozzle becomes finer at higher pressures and the nozzle can therefore be used over a wide range of pressures above 1 bar (1 atmosphere) as a consistent level of comfort for the user is maintained.

The direction of rotation given to the water as it passes the guide vanes 5 is not important and the vanes may be angled to cause the water to be swirled in a clockwise or anti-clockwise direction. It is of course possible that the natural rotation of the water caused by the location on the earth's surface, i.e. anti-clockwise in the northern hemisphere and clockwise in the southern hemisphere, could effect the spray shape and accordingly differently angled guide vane members may be fitted depending upon the intended geographical location in use.

The spray pattern without any additional flow control device is satisfactory throughout the pressure ranges normally encountered but for economy and additional control when the inlet pressure is higher than is required for efficient operation of the nozzle the spray head may incorporate a flow control device. A flow control device of known type utilizing a flexible 'O' ring to provide a variable orifice and which moves on a conical seating according to the inlet pressure of the water supply has been found suitable for this application. A flow control device of this type has a cylindrical body which can be housed conveniently in the chamber 13 and 30 of respective secondary body parts 9 and 22. Moreover, the orifice of this type of flow control device does not affect the spray pattern and is unlikely to become blocked by scale or sediment and is therefore compatible with the aim of the invention to provide a spray nozzle which is unlikely to suffer a blockage in use. The spray nozzle is suitable for use in apparatus including a mixer valve for hot and cold water.

It will be appreciated from the foregoing description that the invention resides in an improved spray nozzle primarily for use with high pressure water systems so that the desired "full" spray cone from the single nozzle orifice is ensured. Moreover the "full" spray is achieved by nozzle components which are simple to manufacture and readily fitted to a spray head.

The nozzle assembly comprising the body 1, guide member 3, and retaining ring 8 may be supplied separately for direct connection to a supply pipe or fitted to a secondary body part with or without a flow control device.

It will be further appreciated that minor modifications may be made to the nozzle and associated parts without departing from the scope of the invention. For example, the shape of the chamber for housing a flow control device may be changed to accord with the proprietory device selected. Other parts such as the nozzle body and secondary body part may also be moulded from plastics material. Minor departures from the dimensional proportions given in the exemplary embodiment will not greatly affect the performance of the nozzle and of course larger or smaller nozzle diameters may be used to increase or decrease the flow rate provided other dimensions are increased or decreased proportionately.

Although in the preferred embodiment the guide vane member 3 is fixed some slight rotation in use does not affect the performance and may be advantageous in preventing a build-up of scale deposits at the interface of the guide member 3 and the body 1. Thus a loosely fitted guide member 3 which is rotated by the water in use may be provided. The number of vanes and their angular spacing may also be varied.

I claim:

1. A spray nozzle for shower-bathing apparatus comprising:

a body having a duct extending from an inlet to the outlet for the passage of water therethrough; and means in association with said body for producing a full cone water spray of circular pattern, said means including walls of right cylindrical configuration in said body to form a single outlet orifice for said outlet, said orifice having a diameter "d", a chamber in said duct positioned between said inlet and said outlet, swirl means fixedly housed in said chamber for imparting a swirling motion to the water and comprising a guide member having a plurality of fixed guide vanes, said guide vanes extending radially in the same plane from a central, generally cylindrical hub having a diameter "h" and having substantially flat guide faces angled relative to the hub axis, such that said guide vanes and said chamber wall define generally triangular shaped apertures each having a cross-sectional area as great as the cross-sectional area of said nozzle orifice and said chamber having a converging guide wall on the downstream side of the swirl means leading directly to said orifice; and wherein the ratio of d:h is between 0.55 and 0.7 inclusive so as to achieve a full cone water spray of circular pattern over a large range of pressures when in use.

2. A spray nozzle according to claim 1 wherein said chamber comprises a cylindrical inlet part and a frusto-conical outlet part adjacent said inlet part, said frusto-conical outlet part constituting said converging guide wall.

3. A spray nozzle according to claim 2 wherein the inclusive angle of said frusto-conical outlet part is between 90° and 120°.

4. A spray nozzle according to claim 1 wherein there are four guide vanes angularly spaced at 90° from each other.

5. A spray nozzle according to claim 4 wherein said guide faces of said guide vanes are rectangular and are disposed at an angle of substantially 45° to said hub axis.

6. The combination of a spray nozzle according to claim 1 and a ducted connector, said connector being adapted to connect said nozzle to a water supply fitting of said apparatus.

7. A spray nozzle according to claim 4 wherein said guide vanes and the wall of said chamber define four generally traingular shaped apertures and each of said apertures is comparable in area with the area of said nozzle orifice.

8. A spray nozzle according to claim 1 wherein the length of said nozzle orifice (l) is at least equal to the diameter of said nozzle orifice (d).

* * * * *